United States Patent [19]

Bohringer

[11] Patent Number: 4,907,753

[45] Date of Patent: Mar. 13, 1990

[54] CRUSHER HOUSING

[76] Inventor: Paul Bohringer, Heuchlingerstrasse 35, D-7101 Oedheim, Fed. Rep. of Germany

[21] Appl. No.: 304,201

[22] Filed: Jan. 31, 1989

[30] Foreign Application Priority Data

Feb. 5, 1988 [DE] Fed. Rep. of Germany ..... 3803497

[51] Int. Cl.[4] ..... B02C 19/00

[52] U.S. Cl. ..... 241/285 R

[58] Field of Search ..... 241/285 R, 285 A, 285 B, 241/264–269

[56] References Cited

U.S. PATENT DOCUMENTS 4,378,911 4/1983 Adams et al. ..... 241/285 A X

FOREIGN PATENT DOCUMENTS 2229811 1/1974 Fed. Rep. of Germany .

OTHER PUBLICATIONS

Quelle Magazine, 1988, pp. 838–840.

*Primary Examiner*—Mark Rosenbaum

*Attorney, Agent, or Firm*—Mark T. Basseches; Paula T. Basseches

[57] ABSTRACT

A housing, composed of large-area plates, of a heavy crusher for the treatment of rock or recycling material is held together with simple lug and cotter connections instead of by welding or screw unions. This allows transportation in the knocked-down state, erection by unskilled workers on the site and use and - for later relation - simple disassembly.

6 Claims, 3 Drawing Sheets

CRUSHER HOUSING

Figure 1:
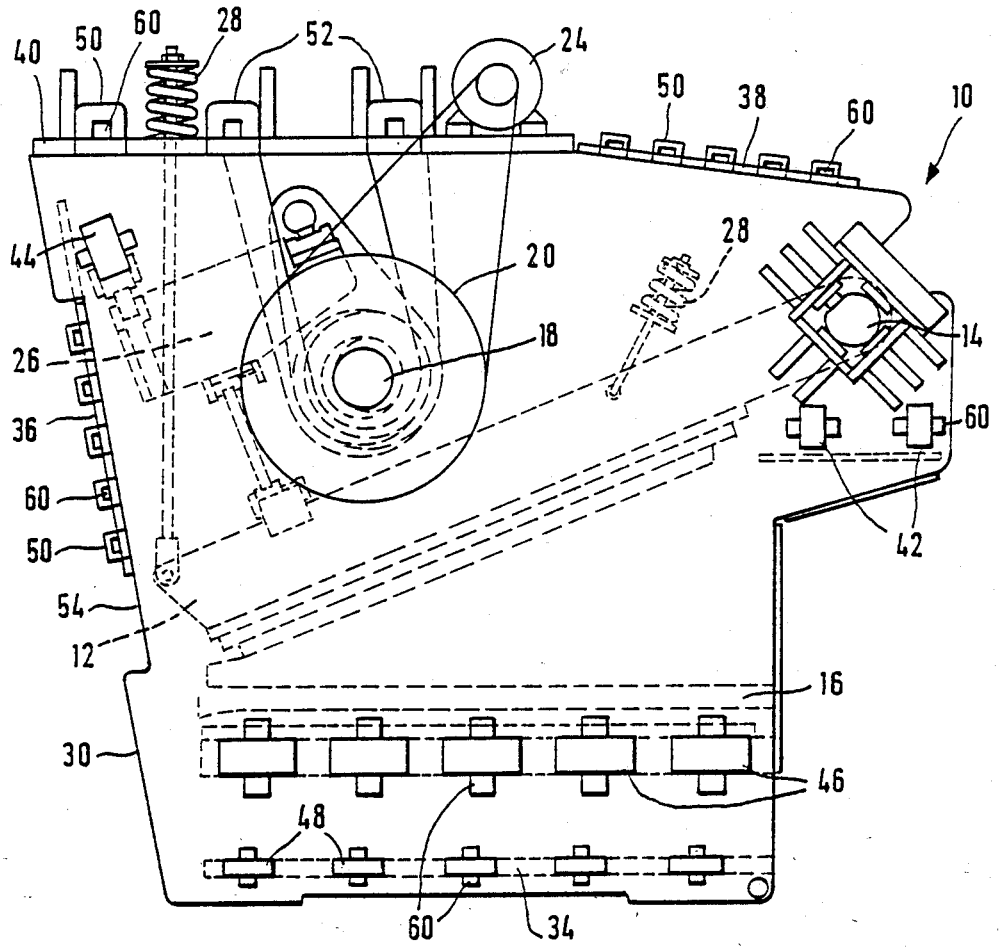

The invention relates to the housing of a treatment machine for mineral basic materials (such as stones, gravel and the like) or for the processing of recycling material (as artificial stones, reinforced concrete and the like). The invention, therefore, relates in particular to the housing of crushers, for instance jaw crushers or top crushers, said housing consisting of plates at right angles to each other firmly joined together at the joints.

Such crushers are large and heavy units, as a rule weighing over 100 t. This considerably complicates transportation and assembly on site. But until now this had to be accepted as a peculiarity of such heavy machines.

Normally the crusher housing consists of side members in which the movable crusher jaw is mounted, a sturdy back wall carrying the drive units, and an anvil constituting the fixed crushing jaw. Heretofore the side members, the back wall, and the anvil formed by numerous plates and double T girders were joined by welding at the joints of the plate type housing parts.

The object of the invention is to propose for the joining of the plate type housing parts a construction whereby handling in transport, assembly, disassembly and relocation of the machine is considerably facilitated.

According to the invention, this problem is solved in that (a) the first of the two plates to be firmly connected has at the joint a series of openings;

(b) the second of the two plates to be firmly connected is provided with a series of lugs which protrude over the butt edge of the second plate and whose projection is greater than the plate thickness of the first plate;

(c) through the openings in the first plate the lugs of the second plate are passed from the inner side of the housing; and (d) into the lugs protruding on the outside of the housing cotters are driven, which brace against the outside of the housing of the first plate, on the one hand, and against the external arches of the lugs of the second plate, on the other hand.

Here, therefore, the welding or screw connection of the heavy plates, hitherto held to be necessary, has been replaced by a simple lug-cotter connection. Such connections are extremely sturdy, easy to handle, and do not release by themselves, especially if a self-locking cotter bracket is provided for the cotter.

Even unskilled workers can manipulate such cotter connections. They are able to establish the cotter connections when the machine is being assembled as well as to release them again when the machine is to be moved and, to facilitate the moving, to be disassembled. Only very simple tools are needed for placing and removing the cotters.

Here, then, for the first time, the housing plates of a crusher housing are no longer joined by weld connections permanently and/or by screw connections in a manner also to be completed at the factory already. Instead, by the lug-cotter connection a type of connection is provided which allows establishing the connection at the user's end and permitting there also a simple undoing and restoring of the connection.

It is thus possible now to transport these large and heavy machines knocked down into their separate parts and subassemblies from the manufacturer to the user. Some more complex subassemblies may be preassembled on individual housing plates. But on the whole the housing is set up only at the site of use and completed in a simple manner. The space requirement for transport is thus greatly reduced. Moreover, also the weight of the individual pieces to be transported is reduced to a fraction of what had to be accepted until now as transport weight for such machines. Of considerable advantage is also that the often necessary moving of the machine on the site is now possible with the described simple knocking down, relocating of the separate parts, and reassembly at the new site. Just as this type of connection results in better cost analysis for production and expenses for the manufacturer, so also for the user this design is much more cost-effective for the cited reasons.

At the manufacturer, no special added expense is necessary. For already in making the housing plates, the openings and lugs necessary for this type of connection can simply be produced at the same time. Both lie fully within the plane of the plate and can be machined out of the plate material without additional expense. In principle it would, of course, be possible to give the lugs a lesser or greater thickness than the respective plate has. But naturally it is simplest and hence appropriate to let the lug have the same thickness as the plate has from the start. On the other hand, it is appropriate to make the openings for insertion of the lug oversize with respect to the cross-sectional dimensions of the lug, to facilitate the fitting together of the housing plates. Fitting is not critical here, because the support of the housing plates on each other will occur along the joints and through the cottering forces.

Figure 2:
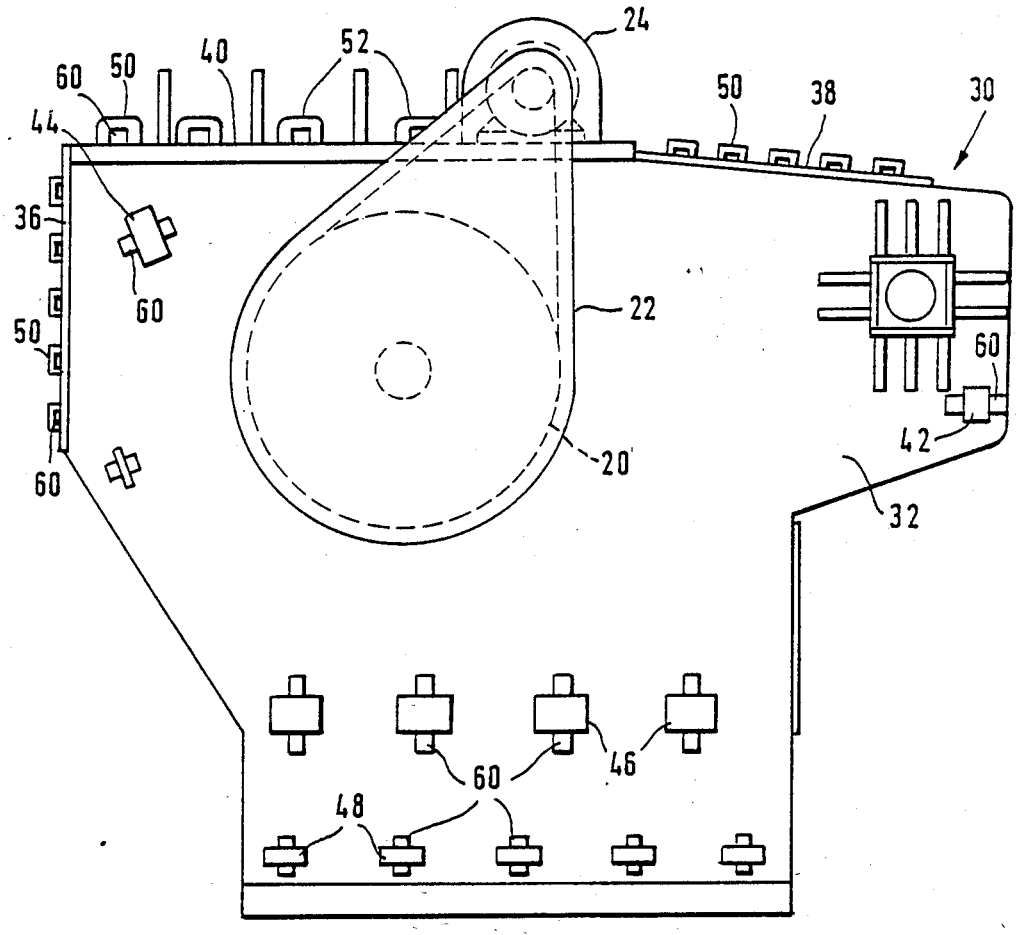
Figure 3:
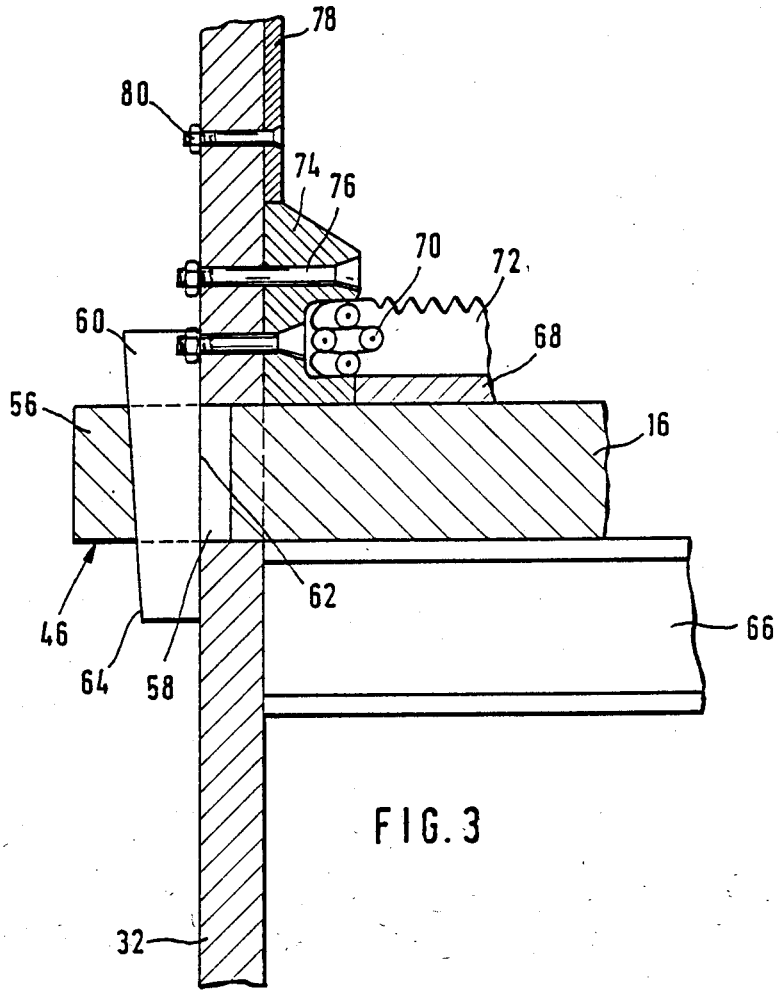

Further details will become evident from the following description of the drawings, in which:

FIG. 1 shows in section a first form of realization of a jaw crusher with partially indicated parts of the crusher inside the housing;

FIG. 2, an exterior view corresponding to FIG. 1, of another form of realization; and FIG. 3, on a larger scale and in section, a detailed view of a lug-cotter connection according to the present invention.

FIG. 1 shows a jaw crusher 10, the movable jaw 12 of which is pivotable about a housing-fixed crushing jaw shaft 14 and cooperates with a massive (solid) anvil 16 serving as crushing abutment. The movable jaw 12 is provided with an eccentric drive 18 mounted on its rear side, the flywheels 20 of which lie outside the housing under a cover 22 (FIG. 2). The drive motor 24 is also mounted externally. Via a mechanism 26 the eccentric drive 18 moves the movable jaw 12 back and forth counter to the action of springs 28, the material to be crushed introduced in crusher 10 being broken up under pressure between the movable jaw 12 and the anvil 16.

The crushing chamber between the movable jaw 12 and anvil 16 as well as the drive are disposed inside a crusher housing 30 formed by large plate type members. The crusher housing consists of two side members 32, parallel as a rule, a bottom plate 34, a rear cover plate 36, and an upper housing cover made of two parts. A relatively thin cover plate 38 connects the side members 32 in the region above the crusher jaw shaft 14 or of the crusher inlet, while a solid supporting plate 40 borders thereon rearwardly and extends to the region over the material discharge of the crusher. On the support plate the entire drive unit including eccentric drive 18 and drive motor 24 is preassembled, so that the drive unit can be handled together with these parts. The two side members 32 are further joined together by two cross stays 42 over the crusher mouth and a cross beam 44 over the mechanism 26 in the upper portion, and by the solid construction of the anvil 16 in the lower portion.

Now for fastening all these housing parts together lug-cotter connections are used, as shown specifically in FIG. 3.

Thus, anvil 16 has appropriately massive lugs 46, which traverse appropriately large openings in the side members 32. It is seen that here a plurality of such lugs 46 of anvil 16 is provided in a row. Thus, in the form of realization per FIG. 1 there are five lugs 46 on the anvil plate which traverse the side members 12 to the outside, four in the form per FIG. 2. Similarly the bottom plate 34 is provided with lugs 48 which again protrude outward through a row/series of openings in the side members 32. As anvil 16 and bottom plate 34 are parallel, also the openings for the lugs 46 and 48 lie in two parallel rows in the side members 32 one above the other. Since, however, the bottom plate 34 is considerably thinner than anvil 16, also the openings for the lugs 48 are correspondingly smaller. FIG. 1 and FIG. 2 each show five openings in a row with traversing lugs 48 of bottom plate 34. Naturally the anvil 16 and bottom plate 34 are formed in this manner relative to both side members 32.

The side members 32 themselves have lugs 50 which traverse, for one thing, corresponding openings in the cover plate 36, and for another such openings in the cover plate 38 and in the support plate 40, respectively. Also in the case of the lugs 50 for connecting the side members 32 with the cover plate 36 and with the cover plate 38, five such lugs 50 are arranged in a row on each side, as the figure shows. In the region of the support plate 40 for the drive, such a connection with lugs 52 can serve also to construct the mounts for the eccentric drive 18 at the support plate 40.

Lastly also the cross stays 42 and the cross beam 44 can be guided to the outside in the same manner with lugs through the side members 32.

The lugs can protrude outward either in the manner of the lugs 50 for passing through the cover plate 38 in FIG. 1 over the outer edge of the respective housing plate, that is, here of the side members 32. Instead, alternatively, the possibility exists, as shown in FIG. 1 with respect to the lugs 50, which pass through the cover plate 36: Here the lugs 50 are arranged in a concavity 54 of the side members 32 and have a height above the bottom of the concavity 54 which equals the depth of the concavity. Therefore, the outer edge of the lugs 50 provided here is flush with the outer edge of the side members 32 at this point. As a result, here a lug connection can be established without having to increase the size of the plate because of the lug height.

It has become clear from the above explanation that the various housing plates are appropriately provided partly with lugs, partly with openings, or partly with both, so that the entire housing can be fitted together in modular fashion.

Independently of the manner of applying the lugs in the edge region of the housing plates, all such lugs have lug arches 56, which in top view are as a rule rectangular and span a lug hole likewise approximately rectangular in cross section. The lug arches have a projection over the butt edge of the housing plate with which they are of one piece such that after insertion of the lugs through the openings of the respective other housing plate the lug hole 58 remains in part in the region of the plate through which the lug protrudes to the outside, while the normally larger part of the lug hole 58 lies outside the outer surface of this plate, so that it is accessible here.

Now into the here accessible part of the lug hole 58 a cotter 60 is driven. On its side toward the exterior of the housing each cotter 60 has a flat support surface 62 with which the opposite cotter face 64 forms a wedge angle. This wedge angle is formed according to the physical laws of friction at the cotter so that the cotter 60 is self-locking, so that it cannot get loose from the lug. Yet, under the action of an adequate force the cotter can, of course, be driven out, so that the parts are easy to disassemble. This is sometimes necessary for relocation.

It is obvious that the described lug-cotter connections can be established and released quickly but efficiently even by unskilled workers. This now permits for the first time the shipping of such large machines having in part enormous weights and dimensions in a considerably more favorable manner with respect to space requirement and handling. Yet the machine can be assembled and erected on the site ever so simply. Equally simply, often necessary relocation is possible, because for this the machine can be knocked down again.

FIG. 3 shows specifically the new lug-cotter connection in the region of the connection of the plate forming the anvil 16 with one of the two side members 32. There can be seen firstly the upright side member 32, which has an opening matching the thickness of the plate forming the anvil 16. Anvil 16 is provided with a lug 46 protruding over its butt edge. The lug arch 56 of lug 46 has the same thickness as the plate forming the anvil 16. It is simply machined out of the same material. The lug arch 56 spans a lug hole 58, which after passing through comes to lie partly in the opening of the side member 32, but partly also outside, up to the abutment of the butt edge of anvil 16 on the housing interior of the side member 32. Here, now, the cotter 60 is driven in which braces by its flat support face 62 against the surface, forming the housing exterior, of the plate which forms the side member 32, while its opposite cotter face 64 braces against the interior of the lug arch 56. It, too, may, but need not, be angularly adapted to the cotter face 64. In the transverse direction not visible in FIG. 3, the cotter 60 has a width only somewhat smaller than the lug hole 58.

Further the anvil 16 is underlaid with a wear plate 66 reinforcing the crushing abutment and covered on the top with a wear plate 68. The top thereof forms the actual bottom of the crushing chamber. To feed the crushing material a chain conveyor 70 is used, which is fitted with easily exchangable crushing strips 72 extending perpendicular to the feed direction and across the crushing chamber. The chains of the chain conveyor 70 run in a sectional track 74 intended as chain protection, which track is permanently connected by bolts 76 with side members 32, because this part can be installed already at the manufacturer. Further, above the sectional track 74 serving as chain protection an additional wear plate is provided as lateral wedge 78 in the region of the tapering crushing chamber. This lateral wedge, too, is connected with the side member 32 by screw connections 80 at the factory.

Having thus described the invention and illustrated its use, what is claimed as new and is desired to be secured by Letters Patent is:

1. In a crushing machine for the processing of stone, concrete or the like and including a crushing mechanism, the improvement which comprises a modular housing for encompassing said crushing mechanism, said housing comprising a first plate member defining a boundary of said housing and a second plate member disposed generally perpendicular to said first plate member, connection means for removably locking said plate members together, said connection means comprising a series of spaced openings formed in one said plate member and a series of complementally spaced lugs formed on the other said plate member, said lugs of said other member extending through said openings of said one plate member and having portions projecting beyond said one plate member, apertures formed in said projecting portions of said lugs, and a plurality of wedge shaped locking means extending through said apertures, respective opposed surfaces of said locking means being wedged against portions of said lugs defining said apertures, and portions of said one plate member surrounding said openings.

2. Apparatus in accordance with claim 1 wherein said opposed surfaces of said locking means include a first surface parallel to and engaging said one plate member and a second surface oriented at an acute angle to said first surface and engaging said portions of said lug.

3. Apparatus in accordance with claim 2 wherein said lugs are formed integrally with said other plate.

4. Apparatus in accordance with claim 3 wherein said first plate member includes an inwardly directed recess portion, said openings are formed in said recess portion, and said projecting portions of said lugs of said second plate member are encompassed within and project beyond said recess portion into generally coplanar alignment with said first plate member.

5. Apparatus in accordance with claim 3 and including a transversely directed anvil member having a plurality of outwardly projecting lugs, said lugs of said anvil member extending through complementally spaced openings formed in one of said plates, said lugs of said anvil member including portions projecting beyond said openings, apertures formed in said projecting portions of said lugs of said anvil, and wedge shaped locking means extending through said apertures of said lugs of said anvil member and clampingly connecting said anvil member to the plate member through which said anvil lugs extend.

6. In a portable crushing machine for the processing of stone, concrete or the like and including a crushing mechanism, the improvement which comprises a modular housing encompassing said crushing mechanism, said housing including side plates, a front plate and a bottom plate spanning said side plates, each of said front plate and bottom plate abutting and being demountably interconnected to said side plates by connector means removably locking said plates together, said connector means comprising a series of spaced openings formed in one said abutting plate member and a series of complementally spaced lugs extending from the other abutting plate member, said lugs of said other member extending through said openings of said one plate member and having portions projecting beyond said one plate member, apertures formed in said projecting portions of said lugs, and a plurality of wedge-shaped locking means extending through said apertures, respective opposed surfaces of said locking means being wedged against portions of said lugs defining said apertures and portions of said one plate member surrounding said openings, whereby said housing may be disassembled into discrete plate components for transportation by removing said locking means.

* * * * *